United States Patent [19]

Mickler

[11] Patent Number: 4,672,711

[45] Date of Patent: Jun. 16, 1987

[54] VACUUM EXTRACTION APPARATUS

[75] Inventor: Paul W. Mickler, Spartanburg, S.C.

[73] Assignee: E-Vac, Inc., Spartanburg, S.C.

[21] Appl. No.: 802,972

[22] Filed: Nov. 29, 1985

[51] Int. Cl.[4] ..... F26B 13/30

[52] U.S. Cl. ..... 15/306 A; 15/307; 34/160

[58] Field of Search ..... 15/306 A, 307; 68/20; 34/160; 162/208, 312, 313, 366

[56] References Cited

U.S. PATENT DOCUMENTS

| | | | |
|---|---|---|---|
| 1,576,679 | 3/1926 | Smith . | |
| 1,759,804 | 5/1930 | Pieron | 15/307 |
| 2,001,417 | 5/1935 | Gessner | 15/307 |
| 2,164,174 | 6/1939 | Gerard et al. | 34/48 |
| 2,792,587 | 5/1957 | Rose et al. | 15/307 |
| 3,735,444 | 5/1973 | Cecere | 15/307 |
| 4,191,612 | 3/1980 | Araoka | 162/352 |
| 4,301,602 | 11/1981 | Grondin et al. | 34/43 |

*Primary Examiner*—Philip R. Coe

*Attorney, Agent, or Firm*—Luke J. Wilburn, Jr.

[57] ABSTRACT

Improved method and apparatus for automatically adjustably sealing the exposed end portions of the vacuum slot of a vacuum extractor pipe of vacuum extraction equipment over which a running length of web material is passed for vacuum removal of materials therefrom, comprising an elongate flexible element anchored at one end in fixed position adjacent the end of the vacuum pipe slot with the element extending inwardly of the end to overlie and sealingly engage the end portion of the slot, and fluid-actuated motor means operatively attached to other end of the flexible element for exerting a pulling force thereon to lift the element from sealing engagement with the end portion of the slot. The fluid-actuated motor is a pneumatic piston operatively connected to the interior of the vacuum extractor pipe so that variations in vacuum in the vacuum extractor pipe proportionally vary the pulling force of the piston on the flexible sealing element to assist in its sealing engagement with the end portion of the vacuum pipe slot up to the side edge of the web passing thereover.

4 Claims, 5 Drawing Figures

VACUUM EXTRACTION APPARATUS

The present invention relates to an improvement in vacuum extraction apparatus and, more particularly, to an improved mechanism for sealing edge portions of a longitudinally slotted vacuum pipe of a permeable web-treating machine over which the web is passed to extract materials therefrom.

BACKGROUND OF THE INVENTION

Vacuum extraction apparatus for treating moving, liquid-impregnated permeable webs of material, such as fabrics, to remove liquid and chemicals contained therein are well known in the prior art. Certain of such apparatus and equipment are described in the following U.S. patents:

| | | | |
|---|---|---|---|
| U.S. Pat. No. 1,576,679 | Smith | U.S. Pat. No. 3,735,444 | Cecere |
| U.S. Pat. No. 1,759,804 | Pieron | U.S. Pat. No. 4,191,612 | Araoka |
| U.S. Pat. No. 2,164,174 | Gerard, et al. | U.S. Pat. No. 4,301,602 | Grondin, et al. |
| U.S. Pat. No. 2,792,587 | Rose, et al. | | |

In use of vacuum extraction equipment for treatment of textile fabrics, it is a practice to pass a continuous length of fabric impregnated with a liquid, such as water or a liquid composition containing a chemical finish or dyestuff, across an upwardly disposed longitudinal slot of a vacuum pipe extending across the path of movement of the fabric. The interior of the pipe is connected to a source of vacuum which is manually or automatically regulated at a desired reduced pressure to suck liquid and chemicals from the fabric through the slot and into the pipe and thus control the amount of liquid and chemical remaining on the fabric. Because fabrics treated on such vacuum extraction apparatus vary in width, and also can shift slightly from side to side during their guidance over the vacuum slot, it is necessary that the transverse length of the vacuum slot be sufficient to ensure that suction is applied across the full width of the fabric during treatment.

It is a practice to provide means for sealing the ends of the pipe vacuum slot outside the side edges of a moving fabric to maintain a desired vacuum and suction through the fabric during extraction. Certain vacuum slot sealing devices are disclosed in the following U.S. patents:

| | | | |
|---|---|---|---|
| U.S. Pat. No. 1,576,679 | Smith | U.S. Pat. No. 2,792,587 | Rose, et al. |
| U.S. Pat. No. 2,164,174 | Gerard, et al. | U.S. Pat. No. 3,735,444 | Cecere |
| U.S. Pat. No. 4,301,602 | Grondin, et al. | | |

It is also known to employ a vacuum slot sealer for such vacuum extraction equipment which comprises an elongate plastic tube suspended by springs along the vacuum slot of the vacuum pipe so that the ends of the tube outside the fabric side edges reside in and seal the outer exposed end portions of the slot during fabric movement thereacross. It is further known to provide an automatically adjustable vacuum slot sealing device having a flexible sealing strip attached at one end to the end of the vacuum pipe and carried in roller form on a carrier which moves along the vacuum slot in response to fabric edge-sensing means to adjustably close the ends of the vacuum slot up to the side edges of the moving fabric.

U.S. Pat. No. 2,792,587 discloses a vacuum slot sealer for each end portion of a longitudinally slotted vacuum pipe of a cloth-treating machine which comprises a flexible sealing strip anchored at one end to a vertical support on the end of the pipe. A pivotable lever mounted intermediate its ends upon the upper end of the vertical support is connected to the unsecured end of the flexible sealing strip, and a counterweight connected to the other end of the lever counterbalances the sealing strip as it raises and lowers out of and into engagement with the vacuum slot to seal the pipe slot outside the side edges of cloth passing thereover. The counterweight is manually adjusted to change the counterforce applied for the particular cloth width being processed and for the particular level of vacuum being employed in the vacuum pipe.

BRIEF OBJECTS OF THE PRESENT INVENTION

It is an object of the present invention to provide an improved vacuum slot sealing device for vacuum extraction equipment which operates to seal end portions of the vacuum pipe slot outside the side edges of a permeable web of material passing thereover.

It is another object to provide an improved vacuum slot sealing device which moves automatically to effectively close and seal end portions of the vacuum slot of a vacuum pipe up to the side edges of webs of various width passing thereover and under varying degrees of vacuum applied to extract materials from the fabric.

It is a more specific object to provide an automatic vacuum slot sealing device for vacuum extraction equipment which operates under influence of vacuum changes in the vacuum pipe of the equipment to allow a flexible sealing element to close and seal the ends of the slot up to the side edges of a moving fabric which is self-compensating in its counterweight effect for a particular width of fabric being treated and for various levels of vacuum being employed or occurring in the processing operation.

It is a further object to provide an improved method of sealing exposed end portions of a slotted vacuum extraction pipe of vacuum extraction eqiupment employed in the treatment of moving webs of material.

SUMMARY OF THE INVENTION

The invention comprises method and apparatus for automatically adjustably sealing exposed end portions of the vacuum slot of a vacuum extractor pipe over which a permeable web, such as a textile fabric, is passed for suction removal of materials therefrom. The apparatus comprises an elongate flexible element having one end attached to an adjacent end of the vacuum extractor pipe. The flexible element extends inwardly to overlie the slot and to close and seal the end portions of the same. The other end of the flexible element is attached to the movable element of a fluid-actuated motor, such as the piston rod of a pneumatically operated piston, mounted at a fixed location above the slot and inwardly of the end thereof. The piston cylinder is operatively connected by a conduit to the interior of the vacuum extractor pipe the vacuum extractor pipe such that changes in vacuum in the pipe cause corresponding proportional changes in vacuum in the piston cylinder and in the pulling force applied by the piston rod to the end of the flexible sealing element tending to lift it from sealing engagement with the vacuum slot, thereby automatically variably counterbalancing the suction pull of the element into the slot, to adjustably seal the end portion of the vacuum slot up to the side edge of the fabric passing thereacross.

By operatively connecting the supporting piston of the flexible sealing element to respond to pressure variation in the vacuum pipe, the pulling force applied by the piston to the sealing element during movement of the element into and out of its sealing engagement with the vacuum pipe slot varies proportionally with the conditions of vacuum in the vacuum extractor pipe.

BRIEF DESCRIPTION OF THE DRAWINGS

The above as well as other objects of the present invention will become more apparent, and the invention will be better understood, from a detailed description of preferred embodiments of the invention, when taken together with the accompanying drawings, in which.

DETAILED DESCRIPTION OF THE PREFERRED EMBODIMENT

Figure 1:
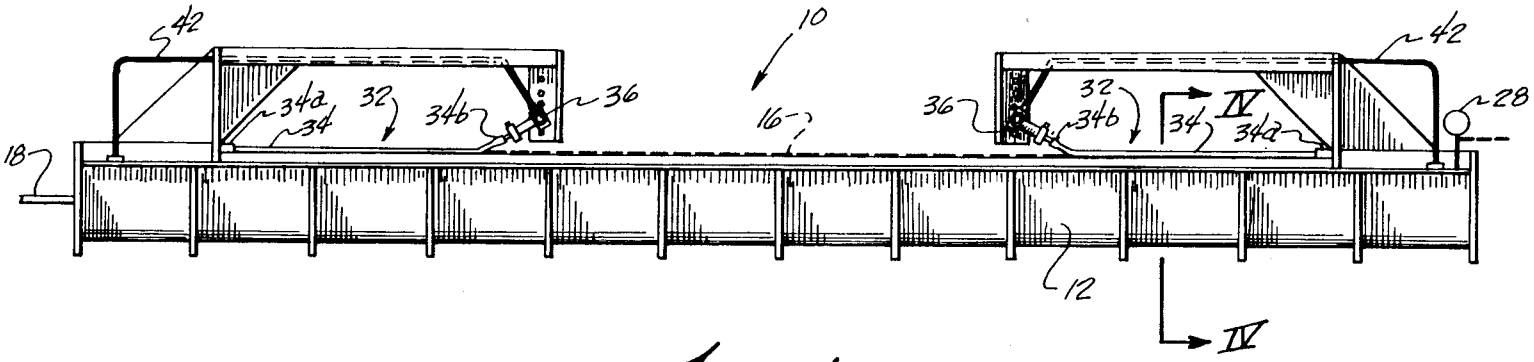
FIG. 1 is a schematic front elevation view of a vacuum extractor pipe of vacuum extraction equipment employed for suction removal of liquid and chemicals from impregnated webs of material passing thereover, and showing vacuum slot sealing device of the present invention incorporated therein.

FIG. 1 shows, in front elevation, a vacuum extraction pipe section 10 of vacuum extraction equipment typically employed in vacuum removal of liquid and chemicals from web materials, such as fabrics, passing thereover. As seen, the equipment includes an elongate tubular manifold, or pipe 12, having an upwardly disposed, elongate longitudinal slot 14 (FIG. 2) extending transversely across the path of travel of a longitudinally moving web of material, such as a textile fabric 16.

Figure 5:
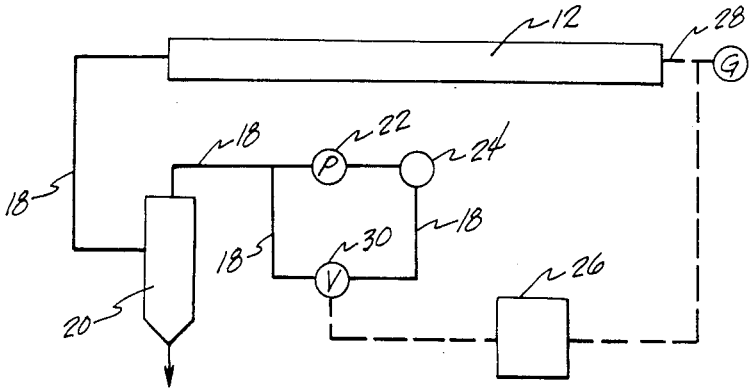
FIG. 5 is a diagrammatic representation showing the principal operative components of the vacuum extraction equipment.

As shown diagrammatically in FIG. 5, the interior of vacuum pipe 12 is connected by suitable conduit 18 to a liquid and air separator 20, the air outlet of which is connected to a vacuum pump 22 with silencer 24. The vacuum extraction equipment is of known type and operated in conventional manner, either manually, or by means of an automatic vacuum level controller 26 which is operatively connected to suitable pressure-sensing means 28 located in the vacuum pipe 12 and operates an adjustable control valve 30, to maintain a desired reduced pressure in the vacuum pipe 12 during operation.

As is conventional in the art, a permeable web of material, such as a woven fabric, which has been impregnated with a suitable liquid, such as water or a chemical composition, e.g., a textile finish or dyestuff, is continuously passed at a desired speed across the vacuum slot 14 of the vacuum pipe 12 in contact therewith. A selected reduced pressure, or vacuum, in the vacuum pipe causes a suction effect through the vacuum slot and air flow through the fabric to withdraw a portion of the liquid and chemicals from the fabric interstices. For a particular fabric construction, based on its speed of movement across the vacuum pipe and the concentration of chemicals in the liquid impregnant therein, the vacuum level in the vacuum pipe can be controlled to provide a desired resultant liquid and chemical content in the fabric being treated.

Figure 2:
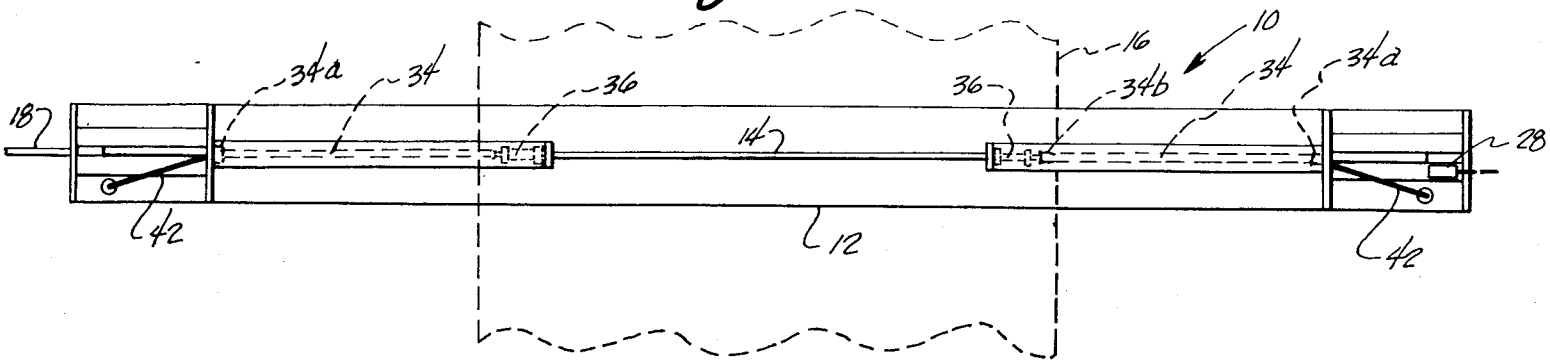
FIG. 2 is a top plan view of the vacuum pipe with slot-sealing devices seen in FIG. 1.

As best seen in FIG. 2, the vacuum slot 14 of the vacuum pipe is of a length, in a direction transverse to the path of movement of the fabric, to accommodate web materials and fabrics of varying widths, typically up to 60" or more. In normal operation, when a continuous length of fabric is passed across the vacuum slot for extraction, the fabric tends to move slightly from side to side due to variations in guidance of the same over the slot. Continuous length fabrics also may vary slightly in width due to irregular shrinkage under prior processing conditions. When several lengths of fabric are seamed together for continuous processing on the vacuum extraction equipment, side edges of one length of fabric may be slightly displaced from side edges of the following length fabric, causing the fabric to track over a different position of the vacuum slot. On occasion, fabrics of different widths are sewn together and continuously processed through the vacuum extraction equipment. In such situations, it is essential that the ends of the vacuum slot of the vacuum pipe outside the side edges of the fabric be closed up to the fabric side edges to prevent loss of vacuum in the pipe and corresponding air flow variations through the fabric interstices.

Figure 3:
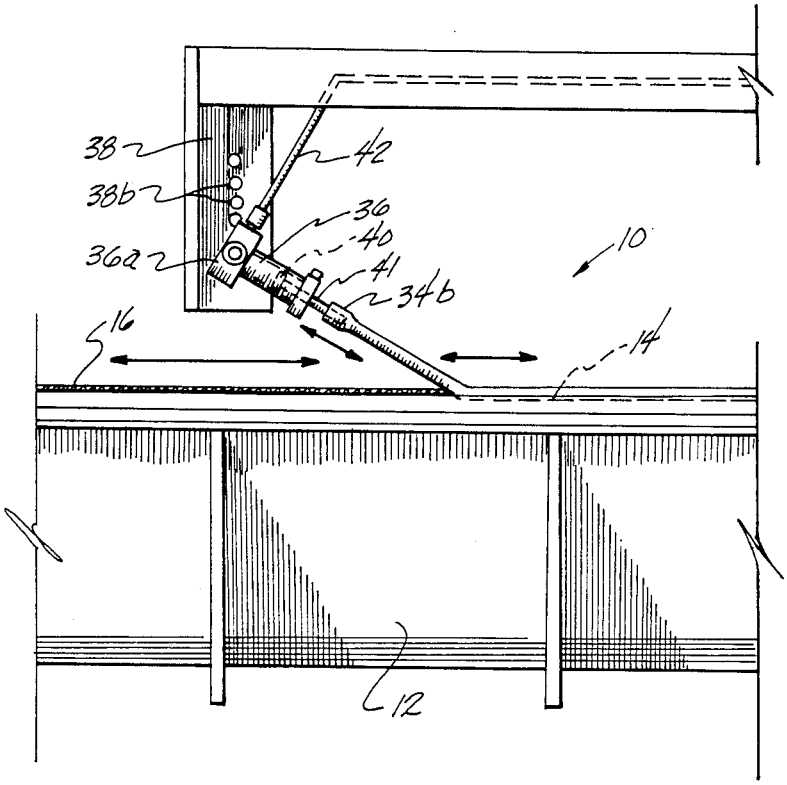
FIG. 3 is an enlarged front elevation view of a right side portion of the vacuum pipe of FIG. 1, showing one end of the flexible sealing element of the slot-sealing device and its attachment to a fluid-actuated motor which exerts a variable pulling force on the end of the element in response to changes in vacuum in the vacuum pipe.
Figure 4:
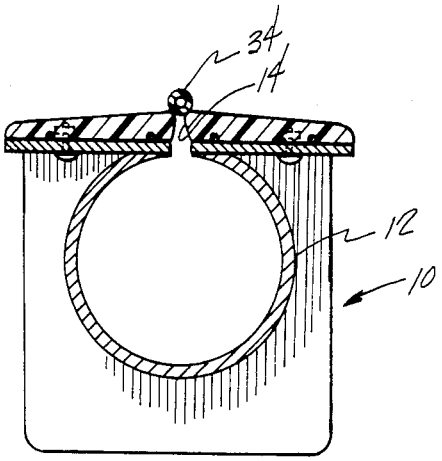
FIG. 4 is a cross-sectional view through the vacuum pipe, taken generally along line IV—IV of FIG. 1.

To ensure effective sealing of the ends of the vacuum slot for fabrics of varying widths under various and varying vacuum levels, the vacuum extraction equipment is provided with slot sealing devices 32 of the present invention, one of which is located adjacent each end of the vacuum pipe 12. As seen in FIGS. 1–3, located at each end of the longitudinal length of the vacuum slot 14 of vacuum pipe 12 is an elongate flexible element, shown as a flexible plastic tube 34, one end **34*a* of which is attached to the end of the vacuum pipe adjacent the end of vacuum slot 14. The plastic tube 34 is disposed to extend inwardly to overlie the vacuum slot outside the side edges of the fabric 16 passing across the slot, and is drawn into the exposed portions of the slot by suction to seal the same. Note FIG. 4**.

The inner end **34*b* of flexible tube 34 is attached to the movable element of a fluid-actuated motor, shown as a pneumatically operated piston and cylinder 36. The base 36*a* of the piston cylinder is pivotally supported at a desired height above the vacuum pipe slot, depending upon the general width of web materials to be treated, on a support frame member 38 located above the pipe. Vertically spaced openings 38*b* are provided for height adjustment of the piston cylinder 36. If narrow width fabrics are to be treated, the base of the piston cylinder is located at a lower elevation above the slot to provide full coverage of the slot by the flexible tube 34 up to the side edges of the fabric. The interior of the cylinder on the side of the piston head 40 opposite the piston rod 41 is operatively connected by a conduit 42 to the interior of the vacuum pipe 12, while the other side is vented to atmosphere. Thus, variations in vacuum in the vacuum pipe cause corresponding proportional variations in vacuum in the piston cylinder and in the pulling force applied to the sealing tube 34 by the piston rod attached to end 34***b* of the tube. The resistance to movement of the flexible sealing tube into sealing engagement with the exposed end portions of the vacuum slot 14 thus varies proportionally with the vacuum level in the pipe 12 and with any variations in vacuum therein which may occur during fabric processing.

Various types of elongate flexible elements may be employed to seal the end portions of the vacuum slot 14 of the vacuum pipe. For a 4" inside diameter vacuum pipe employing a vacuum slot having an effective width of ⅛" in direction of fabric movement, a flexible plastic tube of ¼" diameter works effectively to seal the slot against passage of air therethrough outside the side edges of the fabric.

Typically, the inside diameter of vacuum pipes employed in textile fabric extraction may vary from about 4" to 8", depending upon extraction requirements desired. The size and type fluid-actuated motors employed may be selected to accommodate and meet the needs of the equipment with which it is to be used, e.g., length, weight, and type of flexible elements to be used to seal the ends of the vacuum slot. Typically, for a 4" I.D. vacuum pipe with about 25" long flexible sealing elements, the fluid-actuated motors may be pneumatic pistons and cylinders, such as a 7/16" bore BIMBA® Model BRT-01-D cylinder having a 2" stroke length. The stroke length of the piston, of course, may be selected for the degree of movement desired therein.

In operation, as an impregnated fabric 16 containing a liquid impregnant passes across the vacuum slot, reduced pressure in the vacuum pipe causes a suction in the slot to create air flow through the fabric and draw a desired amount of liquid from the interstices of the fabric. The suction also draws the sealing tubes 34 into sealing engagement with the exposed portions of the vacuum slot outside side edges of the fabric. As the fabric may shift slightly from side to side during its guidance across the slot, any variations occurring in vacuum in the vacuum pipe produce corresponding proportional vacuum variations in the cylinders of the piston motors, causing the piston rods 41 attached to the ends 34*b* of each flexible tube 34 to vary proportionally the pulling force resisting sealing engagement of the sealing tubes 34 with the ends of the slot up to the side edges of the fabric. The sealing tubes 34 thus lift from sealing engagement with the slot by pressure of the side edges of the fabric as they may move toward the ends of the slot and by the assisting force applied by the pistons through their attached piston rods 41. When the fabric edges change position in their passage across the slot due to changes in fabric width, seaming discrepencies, and the like, the sealing elements of the sealing devices thus compensate automatically and are assisted in their movement by the lifting force of the pistons which respond proportionally to vacuum changes in the vacuum pipe 12.

The length and effective coverage of the flexible sealing elements of the present invention may be varied and selected to ensure coverage of the end portions of the vacuum slot necessary to ensure full sealing engagement of the sealing elements with exposed portions of the slot 14 for the various widths of web materials being treated.

That which is claimed is:

1. An automatic vacuum sealer adapted to be used with a longitudinally slotted vacuum pipe of a fabric-treating machine over which fabric is passed to have liquid compositions extracted therefrom to provide a desired liquid composition content therein, said vacuum sealer comprising an elongate flexible element, means for securing one end of the element to a vacuum pipe adjacent one end of the longitudinal slot thereof with the element extending along a length of the end portion of the slot for adjustable sealing engagement therewith, fluid-operated motor means having a movable member attached to the other end of the elongate flexible member, conduit means operatively connected to the motor means for attachment to the vacuum pipe in communication with the interior thereof, and means for mounting the motor means adjacent the vacuum pipe whereby variations in vacuum in the the vacuum pipe move the movable member to proportionally vary its pulling force on the elongate flexible element in its movement into and out of sealing engagement with the vacuum slot.

2. Apparatus as defined in claim 1 wherein said motor means comprises a pneumatically operated piston having a piston cylinder connected to said conduit means, and said movable member comprises a piston rod connected to said other end of the elongate flexible member.

3. Apparatus as defined in claim 1 wherein said elongate flexible element comprises a flexible plastic tube having the diameter sufficient to seal the vacuum slot of vacuum extraction equipment with which it is employed to prevent the passage of air therethrough.

4. In vacuum extraction apparatus for removing materials from a running length of web material having a longitudinally slotted vacuum pipe over which a running length of web material is passed in communication with the slot for vacuum removal of material from the web material; the improvement therewith comprising means for automatically adjustably sealing exposed end portions of the vacuum slot outside edges of the running length of web material, said sealing means comprising a pair of elongate, flexible elements, means for anchoring one end of each flexible element in fixed position adjacent a respective end of the vacuum pipe with each element extending inwardly of the respective ends of the slot to overlie and sealingly engage the end portion of the same, a fluid-actuated motor operatively attached to the other end of each flexible element for exerting pulling force thereon tending to lift the element from sealing engagement with the respective end portion of the slot, each motor including a movable member connected to said other end of each respective flexible element, and conduit means operatively connecting each motor to the interior of the vacuum extractor pipe whereby variations in vacuum in the vacuum extractor pipe porportionally varies the pulling force of each movable member on its flexible element to maintain it in sealing engagement with respective end portions of the pipe slot up to the edges of the web material passing over the pipe slot.

* * * * *